US005341909A

United States Patent [19]

Ahls et al.

[11] Patent Number: 5,341,909

[45] Date of Patent: Aug. 30, 1994

[54] LINEAR WHEEL ESCALATOR HANDRAIL DRIVE

[75] Inventors: Hermann W. Ahls, Obernkirchen; Alfons Von Herz, Stadthagen, both of Fed. Rep. of Germany

[73] Assignee: Otis Elevator Company, Farmington, Conn.

[21] Appl. No.: 114,018

[22] Filed: Aug. 30, 1993

[51] Int. Cl.[5] ..... B66B 23/02

[52] U.S. Cl. ..... 198/335

[58] Field of Search ..... 198/331, 335, 336, 835

[56] References Cited

U.S. PATENT DOCUMENTS

| | | | |
|---|---|---|---|
| 3,414,109 | 12/1968 | Clark | 198/335 |
| 3,779,360 | 12/1973 | Taher et al. | 198/335 |
| 4,134,883 | 1/1979 | Mendelsohn et al. | 198/335 X |
| 4,200,177 | 4/1980 | Sato et al. | 198/335 |
| 4,674,619 | 6/1987 | Nakazawa et al. | 198/336 X |
| 4,901,839 | 2/1990 | Johnson | 198/335 |
| 4,998,613 | 3/1991 | Rivera et al. | 198/335 |
| 5,018,616 | 5/1991 | Johnson et al. | 198/335 |
| 5,062,520 | 11/1991 | Nguyen et al. | 198/335 |
| 5,131,521 | 7/1992 | Johnson et al. | 198/335 |
| 5,133,443 | 7/1992 | Johnson et al. | 198/335 |

*Primary Examiner*—D. Glenn Dayoan

[57] ABSTRACT

A direct drive wheel to handrail contact drive assembly utilizes a pair of drive rollers which contact the handrail directly. The drive rollers are powered by a single drive shaft. A pair of pressure rollers oppose the drive rollers so as to press the handrail against the drive rollers. The pressure rollers are spring biased against the handrail. The drive assembly is used to drive the handrail of an escalator or moving walkway.

9 Claims, 4 Drawing Sheets

LINEAR WHEEL ESCALATOR HANDRAIL DRIVE

TECHNICAL FIELD

This invention relates to a drive assembly for moving the handrail of an escalator or moving walkway, and more particularly, to a drive assembly utilizing drive rollers which directly contact the handrail.

BACKGROUND ART

Handrails on escalators and moving walkways are moved by drive systems which typically are positioned along the return path of travel of the handrail, and which typically engage the handrail in some sort of nip through which the handrail passes. The drive system may include a plurality of friction rollers forming the drive nip; or drive belts; or a combination of belts and rollers. The drive system will typically include a powered component and a reaction or pressure component, both of which can be either a roll or a belt.

Some of the prior art handrail drive systems will create a constant nip pressure on the handrail; and others operate in such a manner as to create a variable nip pressure, which is proportional to the frictional drag imparted to the handrail by changes in the number of passengers on the conveyor, or the like.

Ideally, the handrail drive system should be capable of being adjusted so as to be able to produce a variety of nip pressures; and should provide enhanced contact with the handrail for increased driving power.

U.S. Pat. No. 3,414,109 Clark, granted Dec. 3, 1968; U.S. Pat. No. 3,666,075 Iwata, granted May 30, 1972; U.S. Pat. No. 4,134,883 Mendelsohn, et al., granted Jan. 16, 1979; U.S. Pat. No. 4,151,903 Takahashi, et al., granted May 1, 1979; and U.S. Pat. No. 4,200,177 Sato, et al., granted Apr. 29, 1980 are typical prior art disclosures of passenger conveyor handrail drives.

DISCLOSURE OF THE INVENTION

The handrail drive assembly of this invention includes a plurality of associated drive rollers and reaction rollers which form a drive module. There is a single powered drive shaft for each module, a pair of powered drive rollers, and a pair of idler reaction rollers. Each drive roller combines with a respective one of the reaction rollers to form a nip through which the handrail passes. The drive module thus provides a plurality of drive nips through which the handrail passes.

The drive rollers and power shaft are interconnected by a series of gears or a chain and sprocket assembly which supply motive power to the drive rollers from the drive shaft. The reaction rollers are mounted on a reciprocally movable member which is spring biased toward the handrail and the drive rollers. The spring biasing force is provided via a rod and a swiveling link assembly. The spring force is adjustable so that the nip pressure can be increased or decreased, as required, while, at the same time, the drive assembly nip is flexible so as to be able to accommodate variations in the thickness of the handrail. The reaction roller bias comes from a single spring, whereby the pressure in each of the module nips is consistently equal, irrespective of handrail thickness, and pressure adjustment. When two of the modules are connected in sequence, a single spring can still be used to provide the nip pressure force.

It is, therefore, an object of this invention to provide an escalator or moving walkway handrail drive assembly which provides a plurality of sequential handrail drive nips which are powered by a single drive shaft.

It is a further object of this invention to provide a handrail drive of the character described wherein the pressure of each drive nip is controlled by a single adjustable spring and link assembly.

It is an additional object of this invention to provide a handrail drive assembly of the character described which flexes automatically in response to handrail thickness variations.

These and other objects and advantages of the invention will become more readily apparent from the following detailed description of a preferred embodiment of the invention when considered in conjunction with the accompanying drawings, in which:

BEST MODE FOR CARRYING OUT THE INVENTION

Figure 1:
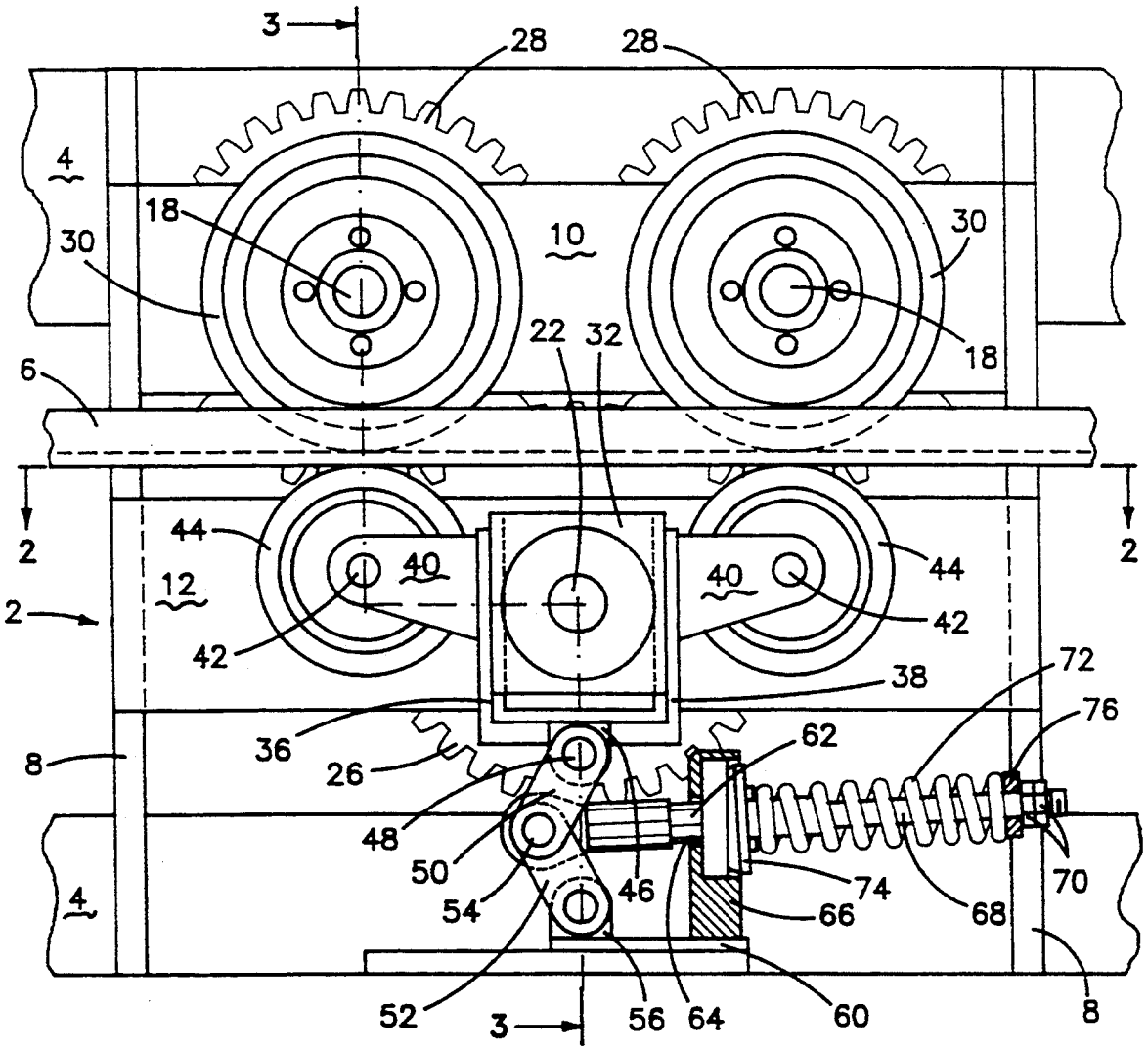
FIG. 1 is a front elevational view of a two-nip handrail drive assembly module formed in accordance with this invention.
Figure 2:
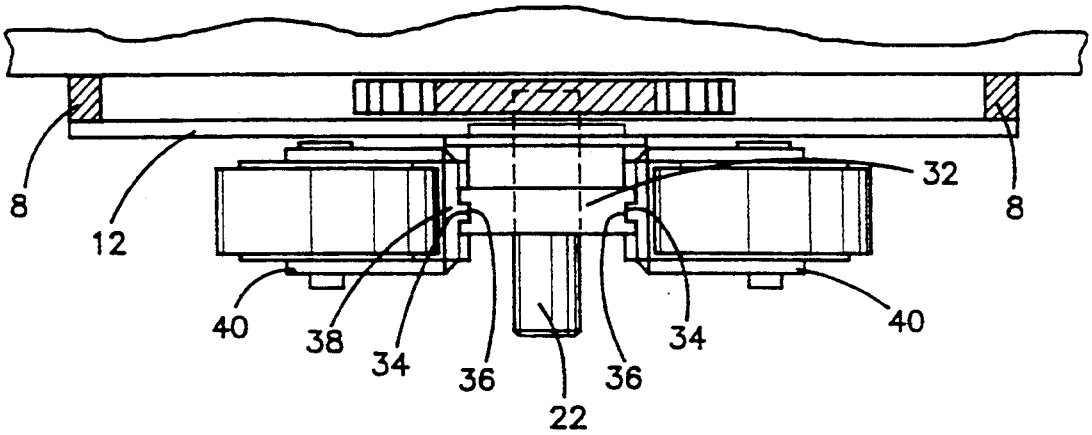
FIG. 2 is a sectional view of the drive assembly taken along line 2—2 of FIG. 1.
Figure 3:
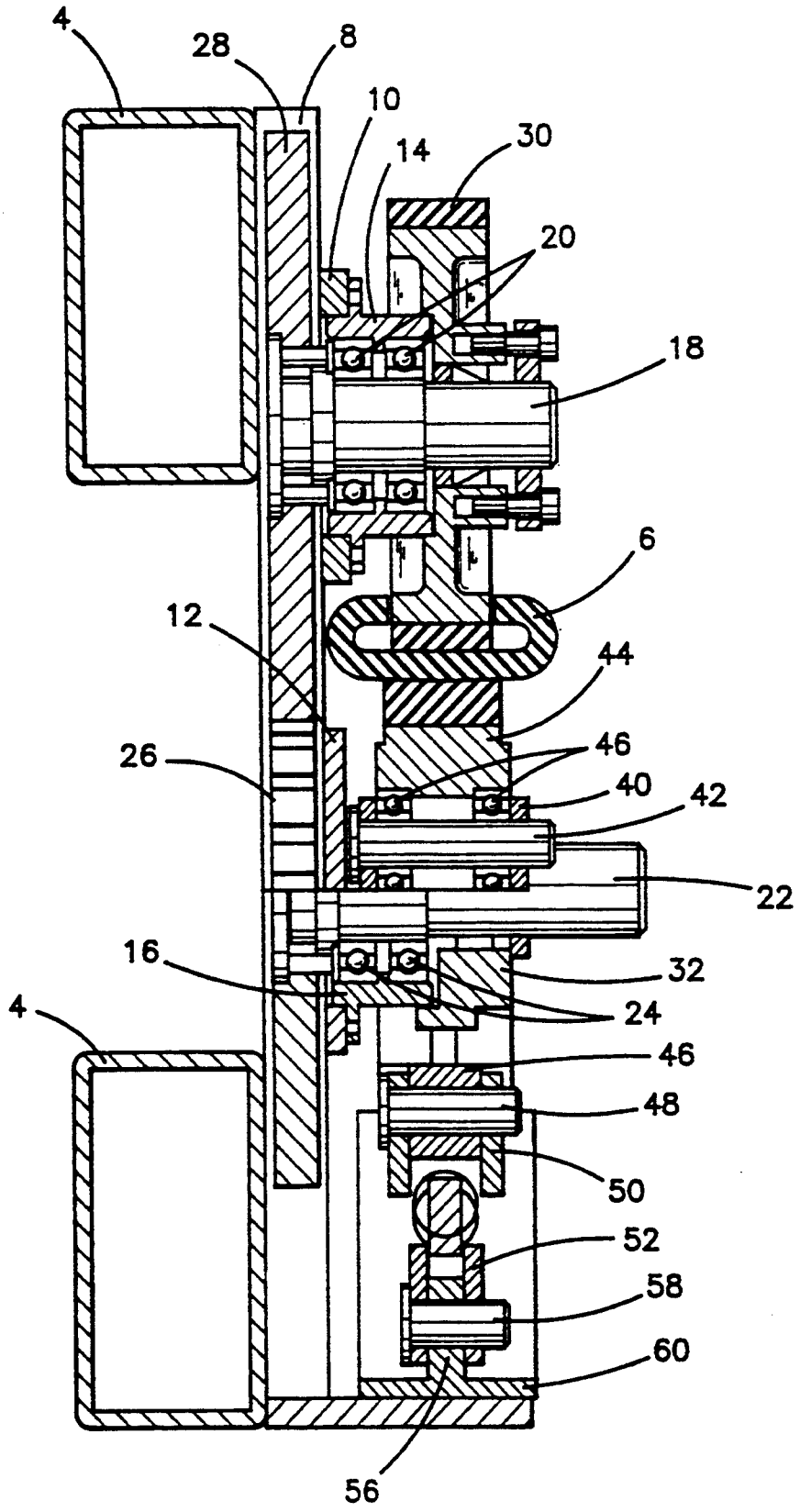
FIG. 3 is a sectional view taken along line 3—3 of FIG. 1.
Figure 4:
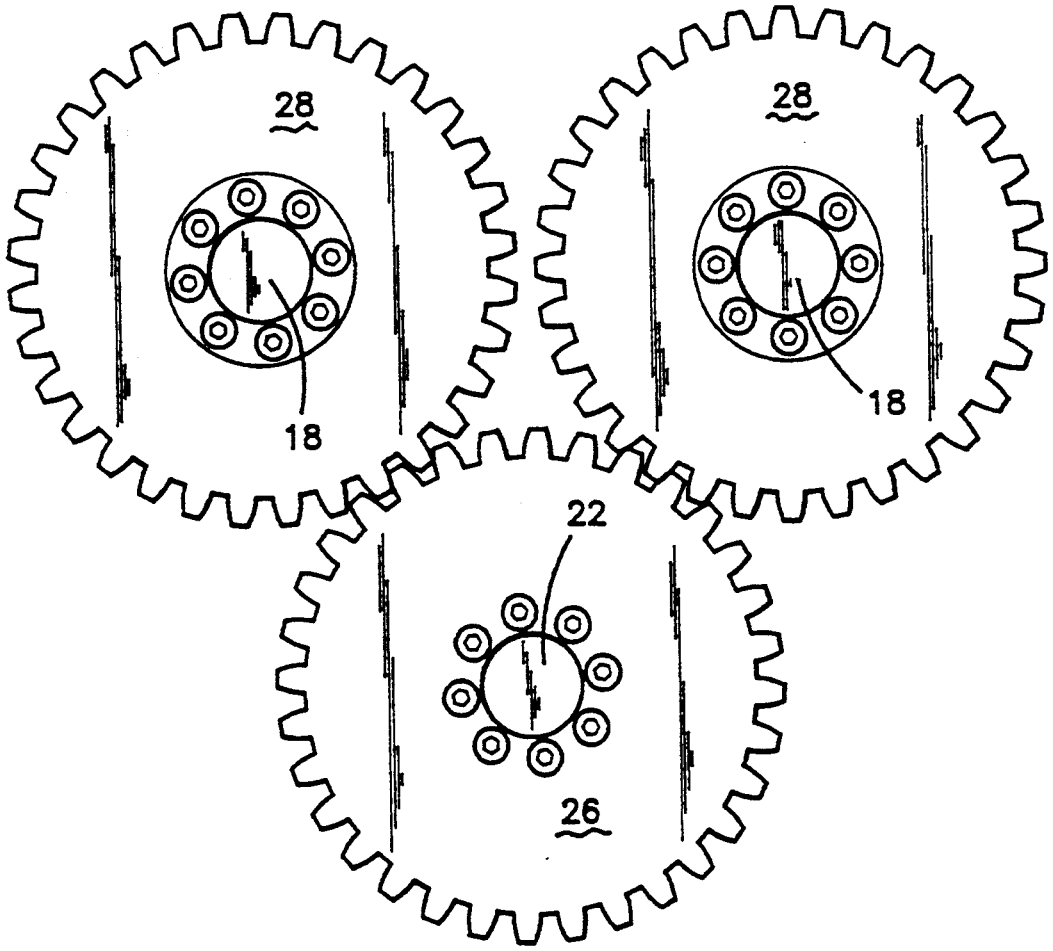
FIG. 4 is an elevational view of the gear side of the drive assembly.

Referring now to the drawings, there is shown in FIGS. 1–4 a first embodiment of a two-nip handrail drive assembly module which is denoted generally by the numeral 2, which module 2 is mounted on the escalator truss 4 along the return path of travel of the handrail 6. The module 2 includes a support frame which comprises a pair of struts 8 which are secured directly to the truss 4; and a pair of plates 10 and 12 which extend between and to are secured to the struts 8. A pair of bushings 14 are set in the plate 10, and a bushing 16 is set in the plate 12. These bushings 14 and 16 support the powered portions of the drive assembly on the module 2.

The power portion of the drive assembly includes a pair of drive roller shafts 18 which are mounted in bearings 20 set in the bushings 14. The shafts 18 thus are rotatably mounted in the plate 10. A powered shaft 22 is mounted in bearings 24 which are set in the bushing 16. The shaft 22 is thus also rotatably mounted in the plate 12. A power sprocket or gear 26 is keyed to the shaft 22 and is operably connected to the step drive motor (not shown) so as to supply motive power to the shaft 22. The sprocket 26 meshes with drive roller sprockets, or gears, 28 which are keyed to the drive roller shafts 18. Drive rollers 30 are keyed to the drive roller shafts 18 so as to rotate therewith. The drive rollers 30 engage the inner side of the handrail 6 to provide the motive power for moving the handrail 6 along its path of travel.

The reaction, or nip pressure portion of the drive assembly consists of the following components. A guide plate 32 is mounted on the plate 12 about the shaft 22. The guide plate 32 includes grooves 34 (see FIG. 2) in which ribs 36 formed on a frame member 38 are slidably received. The frame 38 has a pair of laterally extending bifurcated arms 40 mounted thereon, which arms 40 have stub axles 42 fixed thereto. Reaction or pressure rollers 44 are journaled to the stub axles 42 via bearings 46 (see FIG. 3) so as to be freely rotatable on the stub axles 42.

As previously noted, the frame 38 is reciprocally movable on the plate 32 toward and away from the handrail 6. A lug 46 depends from the side of the frame 38 away from the handrail 6 which lug 46 has a through passage for receiving a pin 48 which connects a first link 50 to the frame 38. A second link 52 is connected to the first link 50 by a pin 54. The second link 52 is also connected to a lug 56 by means of a pin 58, which lug 56 is fixed to a base 60 that is secured to the truss 4. The two links 50 and 52 thus form a pivoting connection between the fixed base 60 and the movable frame 38 whereby the frame 38 and pressure rollers 44 can be moved toward and away from the handrail 6 in response to reciprocating movement of the links 50 and 52.

A rod 62 is connected to the pin 54 and extends from the links 50, 52 through an opening 64 in a plate 66 which is fixed to the base 60. The end 68 of the rod 62 distal of the links 50, 52 is threaded so as to receive adjustment nuts 70. A coil spring 72 is mounted on the rod 62 and engages stop washers 74 and 76 on the rod 62. The stop washers 74 are seated against the plate 66, and the stop washer 76 seats against the nuts 70. The spring 72 thus serves to bias the rod 62 to the right relative to the base 60, as viewed in FIG. 1. The pin 54 is thus also biased in the same direction whereby the link 50 is biased in a counter-clockwise direction, and the link 52 is biased in a clockwise direction. The spring 72 thus serves to press both of the reaction rollers 44 against the handrail 6 by means of the rod 62, links 50, 52, frame 38 and arms 40. Both of the reaction rollers 44 are thus pressed or biased against the handrail 6 so as to press the latter against the drive rollers 30. The reaction pressure imparted to the rollers 44 is a yielding pressure so that the rollers 44 can move toward and away from the drive rollers 30 in response to variations in the thickness of the handrail 6. The reaction force can be varied by adjusting the nuts 70 on the rod 62, i.e., tightening the nuts 70 against the spring 72 will compress the latter to increase the bias force exerted on the rod 62 and links 50, 52 by the spring 72.

Figure 5:
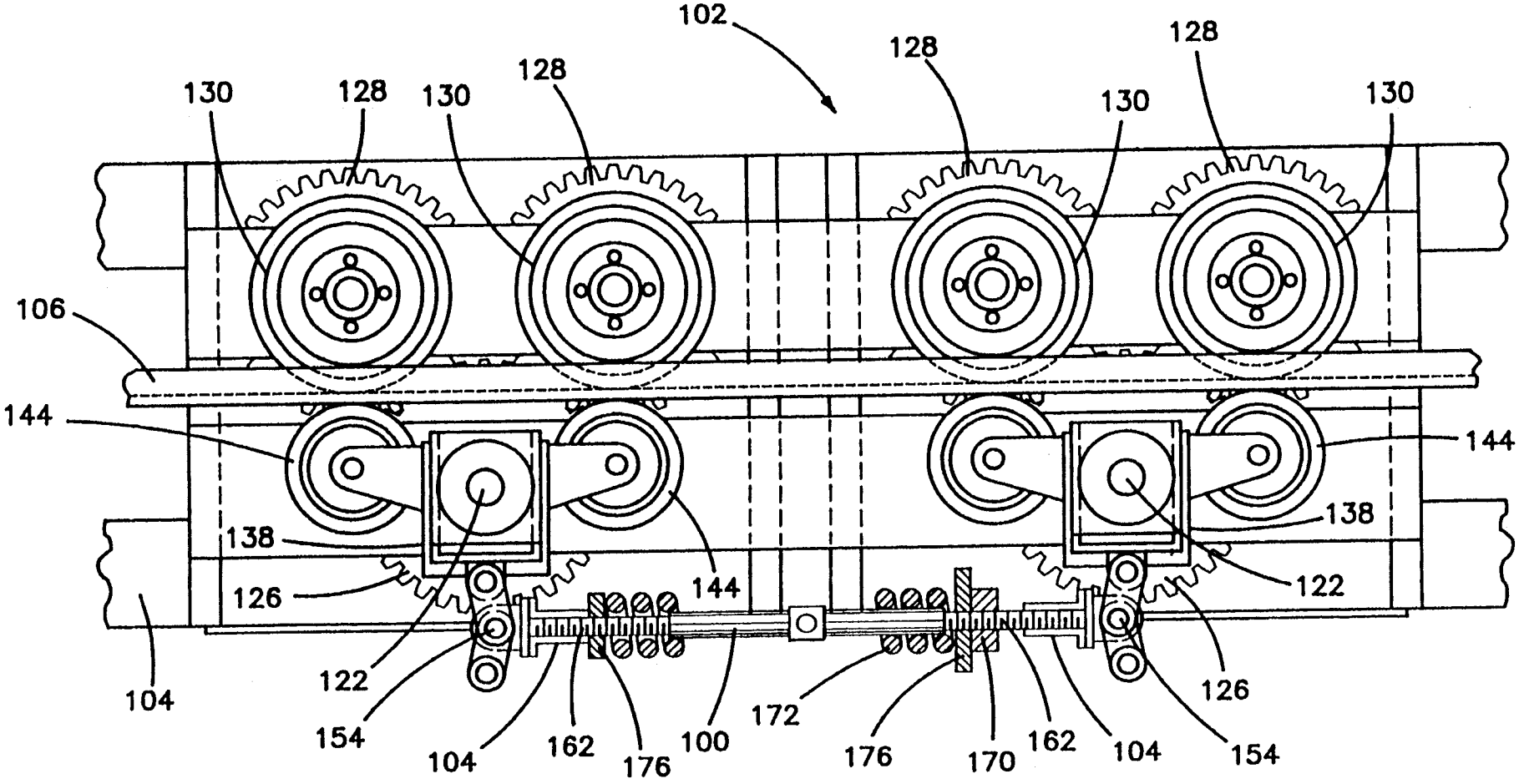
FIG. 5 is a view similar to FIG. 1 but showing a four-nip handrail drive assembly module formed in accordance with the invention.

Referring now to FIG. 5, there is shown a four-nip handrail drive assembly which operates in accordance with the principals of the present invention. This embodiment of the invention is particularly suited for use with lengthy escalators or moving walkways, such as are typically found in airports or the like. This drive assembly will supply a greater driving force to the handrail so as to overcome the increased frictional drag on the handrail with the longer passenger conveyors.

The drive assembly 102 has two pairs of drive rollers 130 and two pairs of reaction rollers 144. There are two drive shafts 122, each connected to the sprocket or gear train 126, 128 to provide power to the drive rollers 130. The mounts and biasing components for the reaction rollers 144 are essentially as described previously. The biasing assembly includes the following components. A control tube 100 is mounted on the truss 104, and control rods 162 are telescoped into opposite ends of the tube 100. The rods 162 are connected to pins 154 on the link-biasing assembly for the frames 138 and reaction rollers 144. Pressure-transmitting sleeves 104 are mounted on ends of the rods 162 so as to engage the pins 154. Washers 176 are also fitted onto the rods 162. The ends of the rods 162 which telescope into the tube 100 are threaded, and an adjustment nut 170 is threaded onto one of the rods 162. A reaction pressure spring 172 is mounted on the tube 100 and engages the washers 176. The spring 172 thus biases both of the rods 162 in opposite directions so as to flex the links and bias the reaction rollers 144 against the handrail 106. The reaction rollers 144 thus all act to establish a flexible and adjustable nip pressure for the handrail drive in the same manner as previously described in connection with the embodiment of FIGS. 1–4.

It will be readily appreciated that the handrail drive assembly of this invention provides multiple nip handrail engagement with a single drive shaft. The hand-rail engagement is flexible and responsive to variations in handrail thickness, while at the same time, being adjustable to vary the driving force imparted to the handrail. The nip flex and nip pressure are both provided by a single spring which acts on the reaction rollers through a simple link assembly.

Since many changes and variations in the disclosed embodiments of this invention may be made without departing from the inventive concept, it is not intended to limit the invention otherwise than as required by the appended claims.

What is claimed is:

1. A handrail drive assembly in combination with an escalator or a moving walkway passenger conveyor, said drive assembly comprising:

a) a plurality of powered drive rollers positioned along a path of travel of the handrail for driving engagement with the handrail;

b) at least one powered drive shaft for providing drive power to the drive assembly;

c) means operably connecting each said drive shaft to more than one of said drive rollers so that each said drive shaft powers at least two of said drive rollers;

d) a plurality of reaction rollers positioned along said path of travel of the handrail, each of said reaction rollers cooperating with a respective drive roller to provide a plurality of drive nips through which the handrail passes;

e) a single spring means for providing a nip pressure bias force for each nip in said drive assembly; and f) flexible means interconnecting said spring means and said reaction rollers, said flexible means being operable to transfer said bias force from said spring means to each of said reaction rollers;

wherein said reaction rollers are mounted on a common support which support is movable toward and away from the handrail.

2. The handrail drive assembly of claim 3 wherein said flexible means comprises a plurality of pivoting links connected to a truss portion of the passenger conveyor, said links being connected to said support.

3. The handrail drive assembly of claim 2 wherein said spring means biases said links in a direction which is skew to the direction of movement of said support and which produces a force vector normal to the path of travel of the handrail.

4. A handrail drive assembly for an escalator or moving walkway passenger conveyor, said drive assembly comprising:

a) a pair of drive rollers operable to engage the handrail along a portion of its path of travel on the conveyor;

b) a single powered drive shaft providing motive power to said drive assembly;

c) means interconnecting said drive shaft to said drive rollers to provide handrail motive power to said drive rollers;

d) a reaction assembly comprising a mount disposed adjacent to the handrail, and a pair of reaction rollers journaled on said mount, said reaction rollers combining with said drive rollers to provide a pair of sequential pressure nips through which the handrail passes, said mount being movable toward and away from the handrail;

e) flexible means interconnecting said mount with a fixed component of the conveyor; and f) spring means operable to bias said flexible means in a predetermined direction so as to cause said flexible means to urge said mount and said reaction rollers against the handrail.

5. The drive assembly of claim 4 wherein said flexible means is a flexible linkage, and further comprising a rod connected to said linkage and extending substantially parallel to the path of travel of the handrail; said spring means being mounted on said rod and operable to bias the latter to cause said linkage to move said mount and reaction rollers toward the handrail.

6. The drive assembly of claim 5 further comprising adjustment means on said rod operable to compress said spring to varying degrees to selectively increase or decrease nip pressure imposed on the handrail.

7. A handrail drive assembly for an escalator or moving walkway passenger conveyor, said drive assembly comprising:

a) a first pair of drive rollers operable to engage the handrail along a return path of travel of the handrail;

b) a first reaction assembly including a first mount disposed adjacent to the handrail, and a first pair of reaction rollers journaled on said first mount, said first pair of reaction rollers combining with said first pair of drive rollers to provide a first pair of sequential pressure nips through which the handrail passes, said first mount being movable toward and away from the handrail;

c) a second pair of drive rollers operable to engage the handrail along said return path of travel;

d) a second reaction assembly including a second mount disposed adjacent to the handrail, and a second pair of reaction rollers journaled on said second mount, said second pair of reaction rollers combining with said second pair of drive rollers to provide a second pair of sequential pressure nips through which the handrail passes, said second mount being movable toward and away from the handrail; and e) means interposed between said first and second reaction assemblies and operable to urge said reaction assemblies toward the handrail and said first and second pairs of drive rollers so as to compress said first and second pairs of pressure nips.

8. The handrail drive assembly of claim 7 wherein said means interposed comprises a support tube extending between said first and second reaction assemblies and generally parallel to the handrail; and a coil spring mounted on said support tube, said coil spring engaging flexible means on said each of said reaction assemblies to bias said reaction rollers in each reaction assembly against the handrail via said flexible means.

9. The handrail drive assembly of claim 8 wherein said flexible means comprise link assemblies pivotally connected to a truss on the conveyor, and hinged to each mount.

* * * * *